United States Patent [19]

Di Stefano

[11] 4,308,002

[45] Dec. 29, 1981

[54] WANKEL-TYPE ENGINE WITH SEMI-CIRCULAR SECTIONAL CONFIGURATION FOR CHAMBER END SURFACE

[76] Inventor: Alfonso Di Stefano, 1413 Wayburn Rd., Grosse Pointe Park, Mich. 48230

[21] Appl. No.: 88,024

[22] Filed: Oct. 25, 1979

[51] Int. Cl.[3] ..... F01C 1/22; F01C 19/04; F01C 19/08; F01C 21/04

[52] U.S. Cl. ..... 418/15; 418/61 A; 418/76; 418/77; 418/79; 418/83; 418/94; 418/116; 418/117; 418/142

[58] Field of Search ..... 418/15, 61 A, 116, 117, 418/122, 142, 76, 77, 79, 83, 94

[56] References Cited

U.S. PATENT DOCUMENTS

| | | | |
|---|---|---|---|
| 1,442,828 | 1/1923 | Rotermund | 418/122 |
| 3,083,699 | 4/1963 | Froede | 418/61 A |
| 3,120,921 | 2/1964 | Hovorka | 418/116 |
| 3,142,440 | 7/1964 | Schagg | 418/117 |
| 3,253,581 | 5/1966 | Nallinger | 418/117 |
| 3,448,727 | 6/1969 | Kobayakawa | 418/15 |
| 4,058,321 | 11/1977 | Gavrun et al. | 418/142 |

FOREIGN PATENT DOCUMENTS

| | | | |
|---|---|---|---|
| 52-4915 | 1/1977 | Japan | 418/117 |
| 995888 | 6/1965 | United Kingdom | 418/83 |

*Primary Examiner*—John J. Vrablik
*Attorney, Agent, or Firm*—Joseph W. Farley

[57] ABSTRACT

A Wankel-type engine has a housing with a chamber therein having parallel, axially spaced side surfaces joined by an end surface which has a semi-circular contour in an axially longitudinal plane. A rotor, eccentrically mounted on a shaft carried by the housing for rotation in the chamber, has a pair of side portions adjacent to the chamber side surfaces and a plurality of lobes, each having an end portion which has a semi-circular configuration corresponding to the semi-circular contour of the chamber end surface. Multi-layer, self-expanding seals engaging the chamber end surface are carried by each rotor end portion, and the rotor side portions carry seals engaging the chamber side surfaces. Lubrication is supplied to the seals. The semi-circular chamber end surface is provided on a separate member mounted between a pair of housing members, or alternatively is provided on complimentary portions of a pair of housing members.

12 Claims, 11 Drawing Figures

FIG. 6
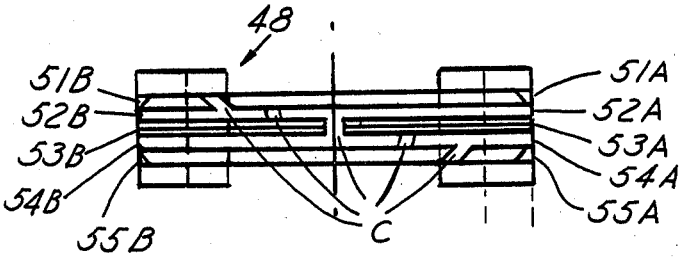
FIG. 5
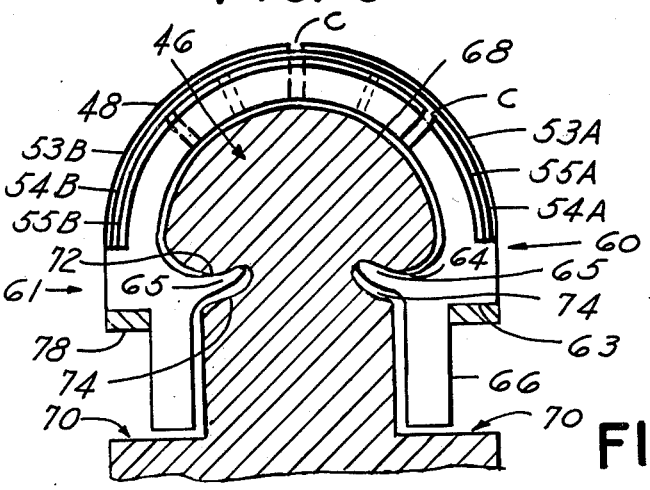
FIG. 7
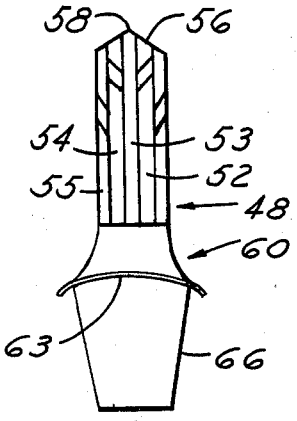
FIG. 7A
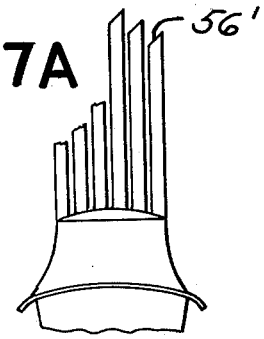
FIG. 9
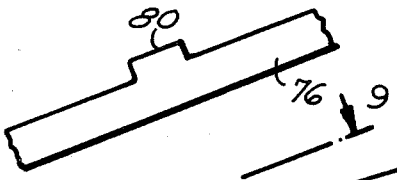
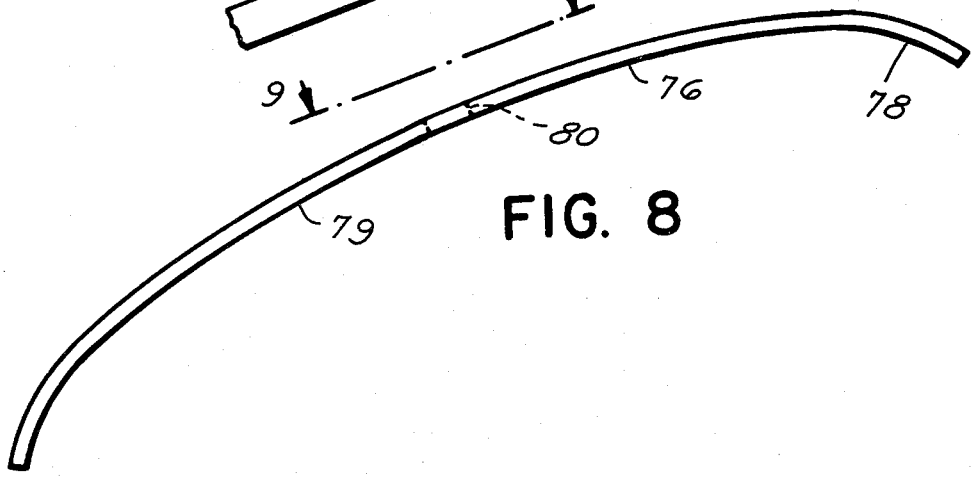
FIG. 8

WANKEL-TYPE ENGINE WITH SEMI-CIRCULAR SECTIONAL CONFIGURATION FOR CHAMBER END SURFACE

This invention relates to improvements in the construction of Wankel-type internal combustion engines having a housing, a shaft carried thereby, a chamber within the housing, and a rotor having a plurality of lobes, the rotor being eccentrically mounted on the shaft for rotation in the chamber. Engines of this type have, in general, been characterized by relatively low efficiency, relatively high fuel consumption and excessive wear, especially between the rotor and the chamber.

The present invention is particularly directed to improvements in the construction of the housing and the chamber, in the construction of seals employed between the rotor and the chamber, and in the lubrication of the engine, which improvements overcome the deficiencies mentioned above of present engines of the Wankel type.

According to the invention, the chamber of an engine of the type described above is defined at least in part by a pair of parallel side surfaces which are spaced axially of the rotational axis of the rotor and which extend radially outward from that axis; and, these side surfaces are connected by an end surface of generally semi-circular sectional configuration. The rotor has a pair of parallel side portions extending adjacent to the side surfaces of the chamber, and each lobe of the rotor has an end portion of generally semi-circular sectional configuration adjacent to the end surface of the chamber. End seals carried by the end portions of the rotor lobes engage the end surface of the chamber, and side seals carried by the side portions of the rotor engage the side surfaces of the chamber.

The end seals are of multi-layer, split construction so as to be self-expanding, and are resiliently urged into engagement with the chamber end surface. The side seals consist of a plurality of side seal members each mounted in a groove in the side portions of the rotor. Each side seal member extends from a radial line through the center of one lobe of the rotor to a corresponding radial line through the next adjacent lobe and is resiliently urged into engagement with the adjacent side surface of the chamber.

Lubrication is supplied through the shaft to the rotor and from the rotor to the end seals.

The housing is formed by a pair of housing members, each having a portion disposed radially outward of the chamber and extending axially into abutment with a complimentary portion of the other housing member, and by a chamber end member which is spaced radially inward from the housing member portion to provide a coolant jacket around the chamber. An interlocking form of construction connects the chamber end member to the housing members when the latter members are suitably secured together with their outer portions in abutment.

The constructional features of the invention summarized above provide improved sealing and lubrication between the rotor and the chamber together with a housing construction which more readily permits the critical end surface of the chamber to be made with wear-resisting properties and to be more adequately cooled. Other features and advantages of the invention will become apparent from the description to follow of the presently preferred embodiment shown in the accompanying drawings.

DESCRIPTION OF THE DRAWINGS

FIG. 5 is a sectional detail taken substantially as indicated by the line 5—5 of FIG. 3 and showing an end seal on the rotor of the engine;

FIG. 6 is a plan view of the outer end of the seal of FIG. 5;

FIG. 7A illustrates an alternative end seal configuration;

FIG. 7 is a side elevation of the seal of FIG. 5;

FIG. 8 is an end elevation of one of the seals on the sides of the rotor of FIG. 3;

FIG. 9 is a fragmentary side elevation of the seal of FIG. 8, taken as indicated by the arrow 9—9.

DESCRIPTION OF THE PREFERRED EMBODIMENT

Figure 1:
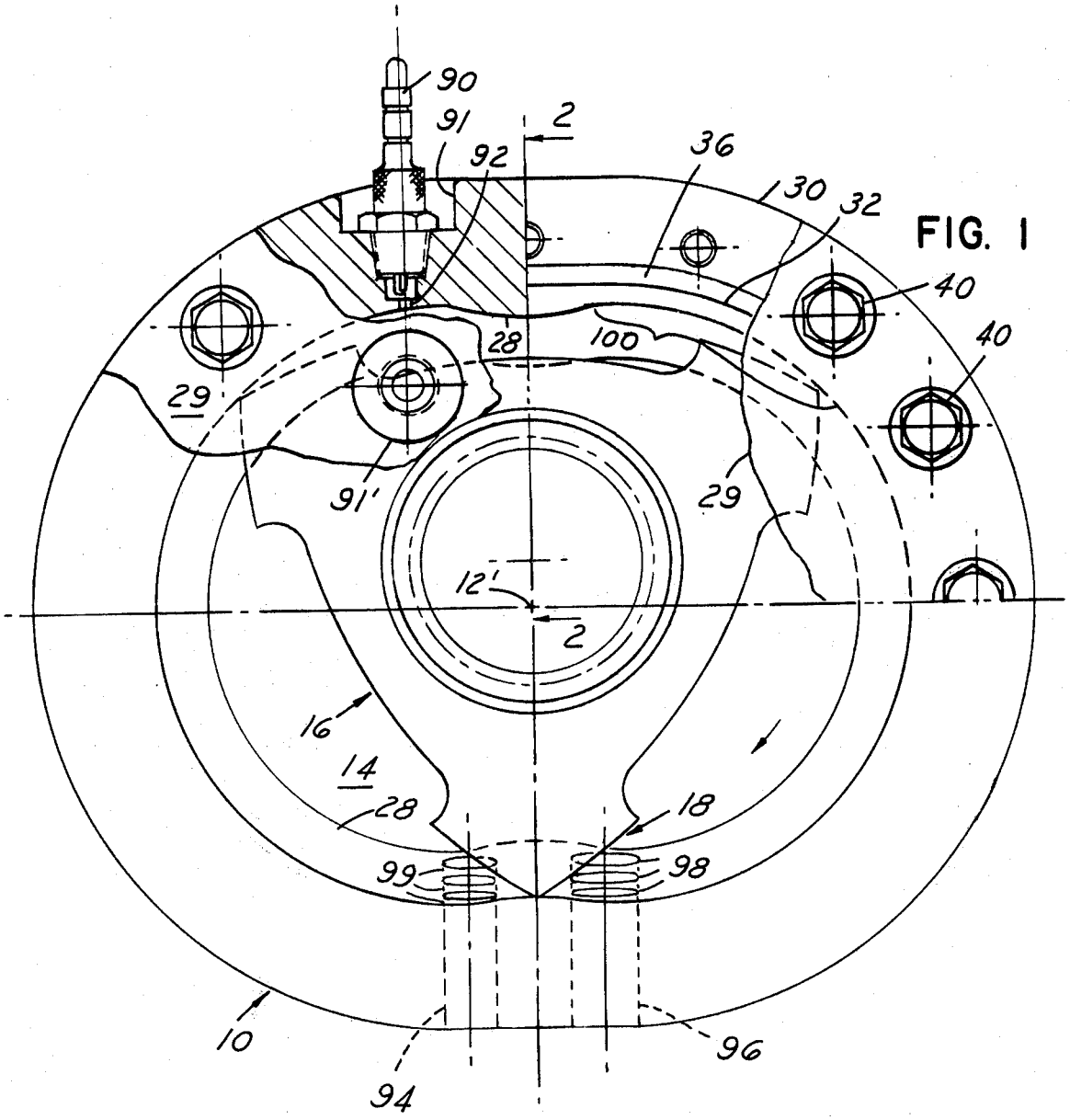
FIG. 1 is an end elevation of a rotary engine constructed in accordance with the invention, the engine housing being partly broken away and sectionalized.
Figure 2:
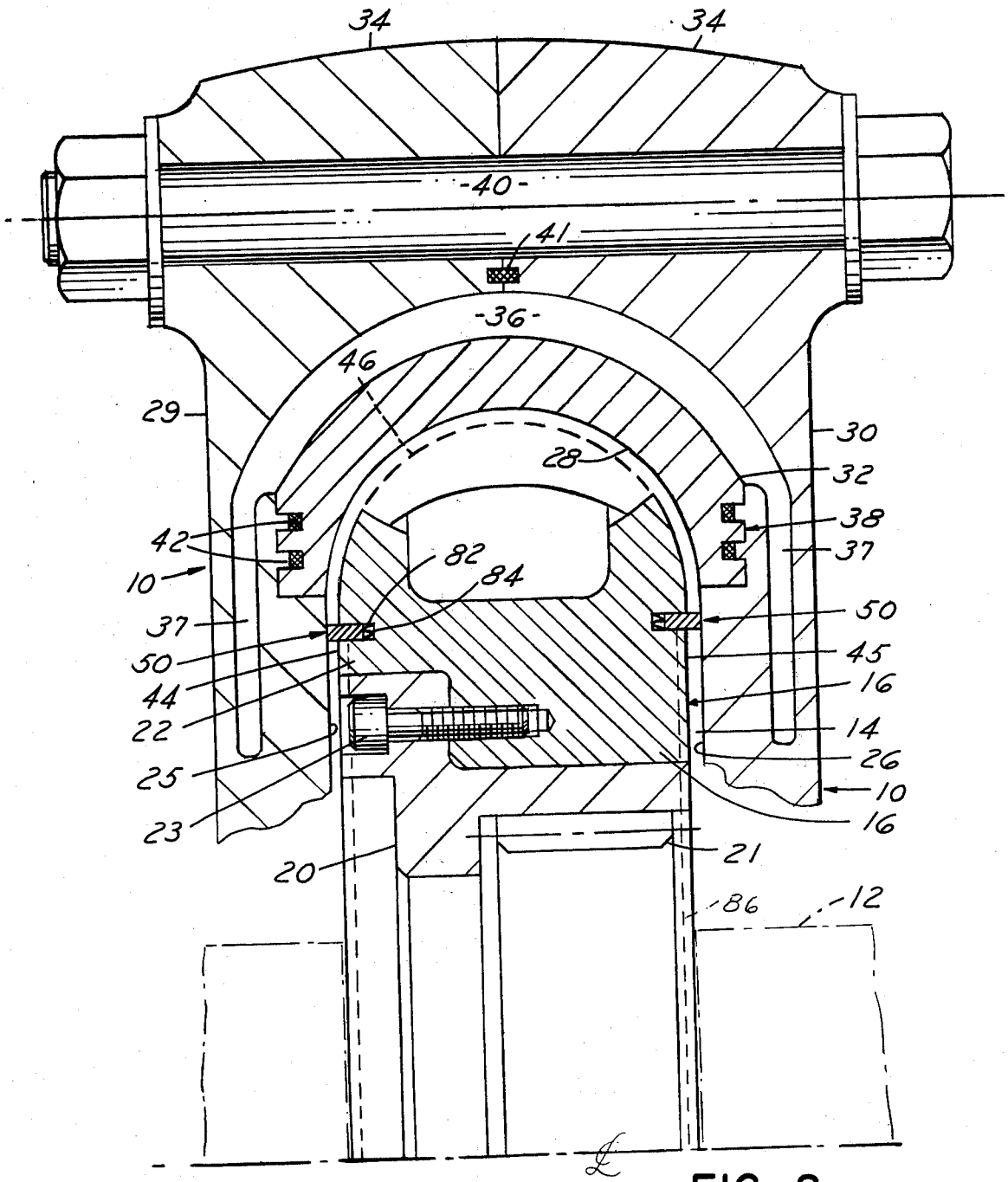
FIG. 2 is an enlarged sectional elevation taken on the line 2—2 of FIG. 1.

Referring to FIGS. 1 and 2, an internal combustion engine of the type to which the invention pertains has a housing 10, a shaft 12 (shown in phantom line in FIG. 2) suitably carried by the housing for rotation on the center 12' of FIG. 1, a chamber 14 within the housing, and a rotor 16 eccentrically mounted on the shaft 12 for rotation in the chamber 14, the rotor having a plurality of lobes 18. A rotor hub 20 (FIG. 2) is provided with splines 21 to engage the eccentric portion of the shaft 12 and a rotor body 22 is secured to the hub 20 by screws 23.

As shown in FIG. 2, the chamber 14 is defined by a pair of parallel side surfaces 25 and 26 which are spaced axially of the rotational axis of the rotor and extend radially outward, and by an end surface 28 which connects the side surfaces 25 and 26 and which has a generally semi-circular sectional configuration. The housing 10 comprises a pair of housing members 29 and 30, the member 29 being provided with the chamber side surface 25 and the member 30 with the chamber side surface 26. A chamber end member 32 is provided with the end surface 28 and the housing members 29, 30 and 32 are detachably interconnected. In the construction shown, the housing members 29 and 30 are each formed with a portion 34 which is disposed radially outward of the chamber 14 and extends axially into abutment with the complimentary portion 34 on the other housing member; and, the chamber end member 32 is spaced radially inward of the housing member portions 34 to provide a coolant jacket 36 around the chamber 14, the coolant jacket extending into cavities 37 formed in each of the housing members 29 and 30. An interlock means 38 is employed to detachably connect the chamber end member 32 and the housing members 29 and 30 when their portions 34 are drawn into axial abutment by bolts 40. A seal 41 is positioned between the portions 34 of the housing members 29 and 30, and seals 42 are provided between the housing members 29 and 30 and the chamber end member 32.

Figure 3:
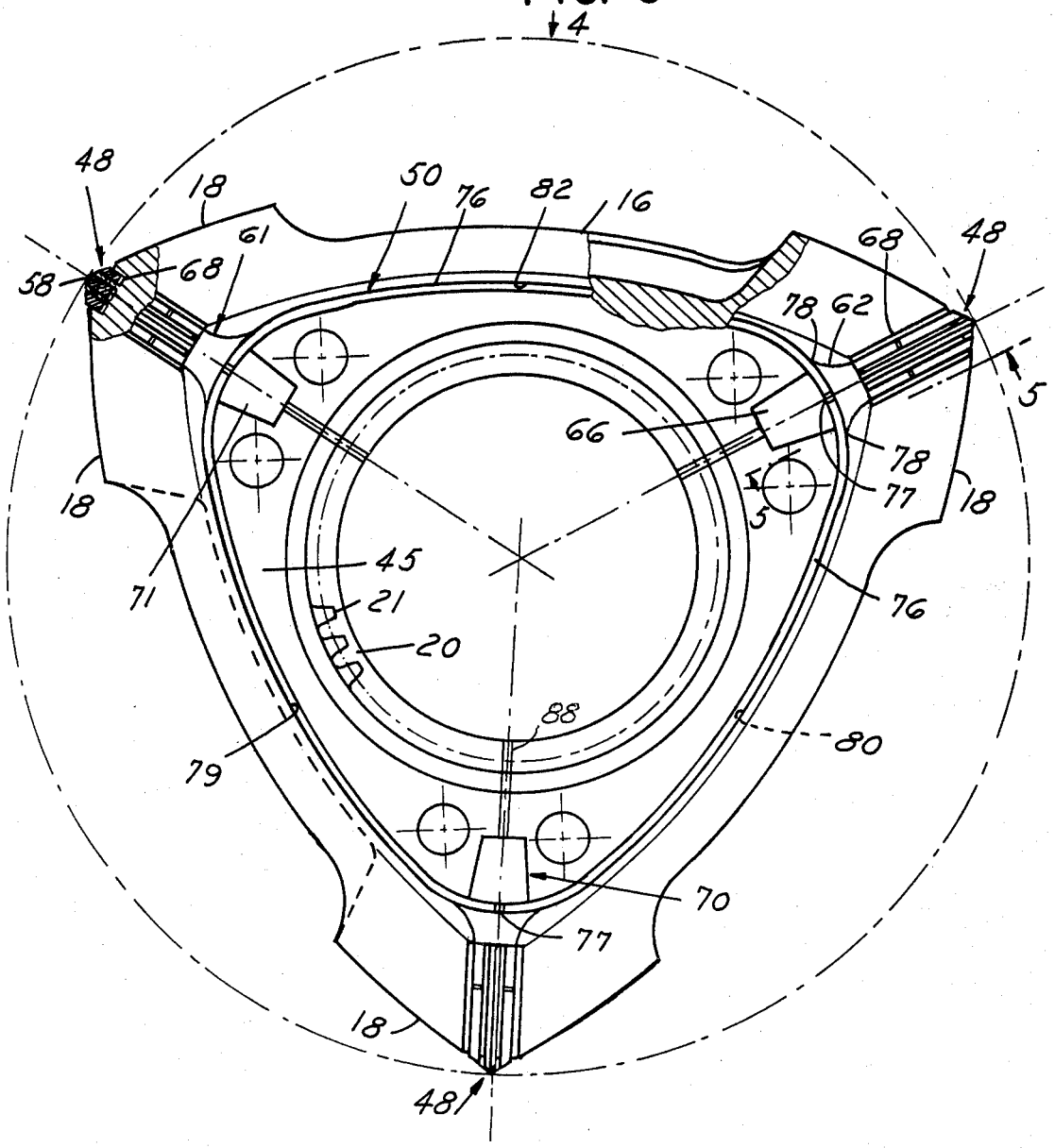
FIG. 3 is an enlarged elevation showing one side of the rotor of the engine of FIG. 1.
Figure 4:
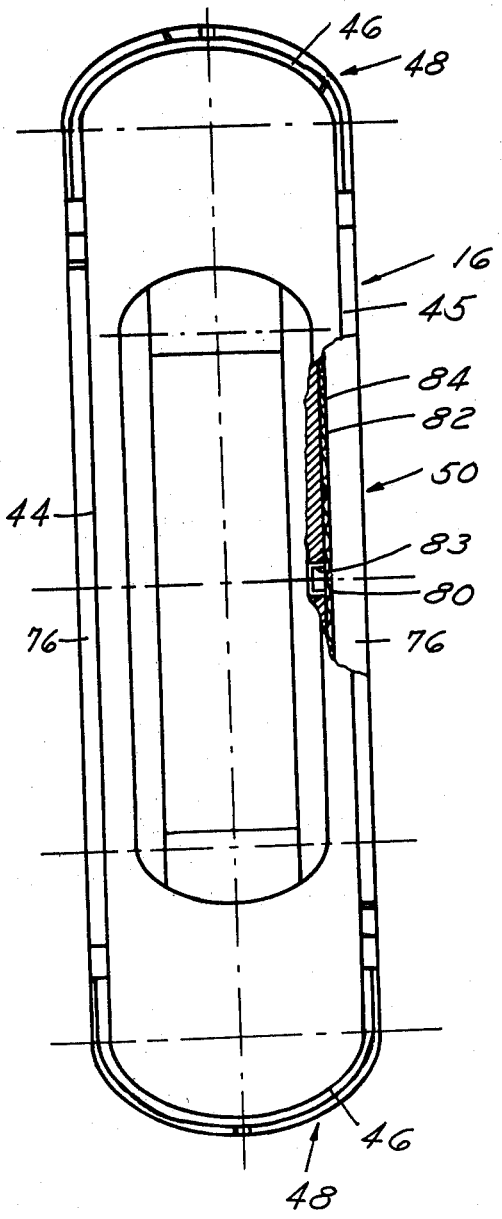
FIG. 4 is a plan view of the rotor, taken as indicated by the arrow 4 of FIG. 3.

FIGS. 2–4 show the overall construction of the rotor 16 which has a pair of parallel side portions 44 and 45 positioned adjacent to the side surfaces 25 and 26, respectively, of the chamber 14, and which also has on each of the lobes 18 an end portion 46 of generally semi-circular sectional configuration positioned adjacent to the end surface 28 of the chamber. End seal means 48, shown in detail in FIGS. 5–7, are carried by the end portion 46 of each rotor lobe 18 and engage the end surface 28. Side seal means 50, shown in detail in FIGS. 8 and 9, are carried by the rotor side portions 44 and 45 and engage the chamber side surfaces 25 and 26.

The end seal means 48 in the construction shown in FIGS. 3 and 5–7, is formed by a plurality of self-expanding seal members arranged in circumferential layers 51–55. Each layer, as best seen in FIGS. 5–7, extends radially outward of the end portion 46 of the rotor 16 and is composed of two seal members which are marked A and B and which are spaced apart by a radial separation marked C. The A seal members of the successive layers 51–55 progressively decrease in circumferential length and the B seal members of the successive layers 51–55 progressively increase in length so that the separations C of the successive layers are spaced circumferentially of each other. Also, the radial dimension to the outer peripheries 56 of the seal members gradually increases (see FIG. 7) from the end layers 51 and 55 to the center layer 53, so that the edge of the seal tapers to a central apex 58.

All of the seal members 51A–55A are joined with a base 60; all of the seal members 51B–55B are joined with a base 61; and this construction is obtained either by forming each group of seal members and their respective base from one piece of material which is slit into layers outwardly of the base, as best shown in FIG. 7, or by forming the seal members separately, each with a portion of the base, and connecting the base portions together in a lamination. Each of the bases 60 and 61 is the same and includes a portion 62 having a shoulder 63 which faces radially inwardly with respect to the axis of rotation of the rotor 16, a radially outwardly facing shoulder 64 which has an axially extending surface, an axially projecting resilient, radially compressible spring tab 65 located adjacent to the shoulder 64, and a radially inwardly projecting tang 66 which is wedge-shaped as seen in FIG. 7.

As shown in FIGS. 3 and 5, the end portion 46 of each lobe 18 of the rotor 16 is formed with a slot 68 adapted to receive the seal members 51A–55A and 51B–55B, and is also formed with pockets 70 adapted to receive the bases 60 and 61 of the seal members. The slot 68 extends circumferentially around the semi-circular sectional contour of the rotor end portion 46 and one of the pockets 70 is located in each of the rotor side portions 44 and 45 radially inward from each end of each slot 68. Each pocket 70 has sides 71 conforming to those of the tang 66 of the seal bases, a radially inwardly facing shoulder 72 (FIG. 5) engageable by the outwardly facing shoulder 64 on the seal base and a recess 74 which receives the spring tab 65 of the seal base.

The construction of the side seal means 50, as shown in FIGS. 2, 3, 4, 8 and 9, consists of a plurality of side seal members 76, each of which extends substantially from a radial line through the center of one lobe 18 of the rotor 16 to a radial line through the center of the next adjacent lobe, there being a small clearance 77 provided between the ends of adjacent seal members 76, as shown in FIG. 3. Each seal member 76, as shown by FIG. 8, is a strip of suitable material formed with relatively sharply curved end portions 78 and a relatively gradually curved medial portion 79 having a locating tab 80. A groove 82 conforming to the shape of the side seal members 76 is formed in each of the rotor side portions 44 and 45 and extends between the pockets 70 therein, the groove having locating means 83 (FIG. 4) engageable by the tab 80 and receiving spring means 84 which urge the seal members 76 axially into engagement with the side surfaces 25 and 26 of the chamber 14.

Assembly of the end and side seal means 48 and 50 is carried out first on one side of the rotor 16 then on the other, after the rotor has been loosely positioned within the chamber end member 32. For example, and considering the engine as shown in FIGS. 2 and 5, the end seals with the seal members 51B–55B and bases 61 are first positioned in the slots 68 on the rotor lobes 18. Side seal members 76 and spring means 84 are then mounted in the slot 82 on the side portion 44 of the rotor and the end portions 78 of the seal members 76 are fitted into engagement with the shoulders 63 on the portions 62 of the end seal bases 61, as shown in FIGS. 3 and 5. The procedure is repeated with the end seals having the seal members 51A–55A and bases 60 and with side seal members 76 and seal means in the slot 82 on the side portion 45 of the rotor. The rotor 16, shaft 12 and chamber end member 32 are then assembled to the housing members 29 and 30 which are connected by the bolts 40.

During the operation of the engine, which is conventional for an engine of this type, centrifugal force on the end seals 48 is resisted by the engagement of the shoulders 64 on the end seal bases 60 and 61 with the inwardly facing surfaces 72 on the rotor, thereby preventing excessive frictional engagement between the end seals 48 and the end surfaces 28 of the chamber 14. The spring tabs 65 on the end seal bases 60 and 61 are compressed during assembly and resiliently urge the seal members 51A–55A and 51B–55B separately into engagement with the adjacent chamber surfaces. Wear of the seals 48 is decreased and their sealing action is improved by lubrication supplied through suitable passages 86 (FIG. 2) in the shaft 12 to radially extending grooves 88 (FIG. 3) in the side portions 44 and 45 of the rotor. Lubricant from these grooves 88 can pass through the clearance 77 between the ends of adjacent side seal members 76 to the seal bases 60 and 61 which may be provided with fine grooves for conducting this lubricant to the seal members 51A–55A and 51B–55B. Centrifugal force and capillary action between the seal members will cause the lubricant to be distributed over their outer peripheries 56.

The foregoing lubrication system also supplies the end portions 78 of the side seal members 76 which will also be lubricated by the centrifugal force acting on any lubricant on the side portions 44 and 45 of the rotor 16. However, a similar lubrication system may be provided to supply lubricant through grooves in the side portions 44 and 45 to the medial portion 79 of the side seal members, if desired. Acceleration and deceleration forces on the side seal members are resisted by engagement of their locating tabs with the recesses 83 in the rotor 16.

Referring to FIG. 1, the engine housing 10 is provided with a spark plug 90 mounted in a socket 91 communicating with an ignition opening 92 in the end surface of the chamber. The end seal means 48 on the rotor 16 extends circumferentially a distance at least as great as the dimension of the opening 92 in the circumferential direction to prevent backfire when ignition takes place. The spark plug 90 may optionally be located as indicated by the socket 91'.

Also, as shown in FIG. 1, the engine housing 10 includes an intake passage 94 and an exhaust passage 96. Each of these passages communicates with the chamber through grill-type openings 98 in the end surface 28 of the chamber, the openings 98 being separated from each other by portions 99 of the end surface 28, which portions 99 are at least as wide as the separations C between the end seal members 51A–55A and 51B–55B, and are located in the paths of movement of the separations C so that the portions 99 support the end seals 48. Damage to the end seals 48 in passing over the inlet and exhaust passages is thereby prevented.

Those skilled in the art will appreciate that transitional contours in the end surface 28 of the chamber 14 are provided in the areas 100 (FIG. 1) where the end seals 48 change attitude with respect to the chamber end surface.

Figure 10:
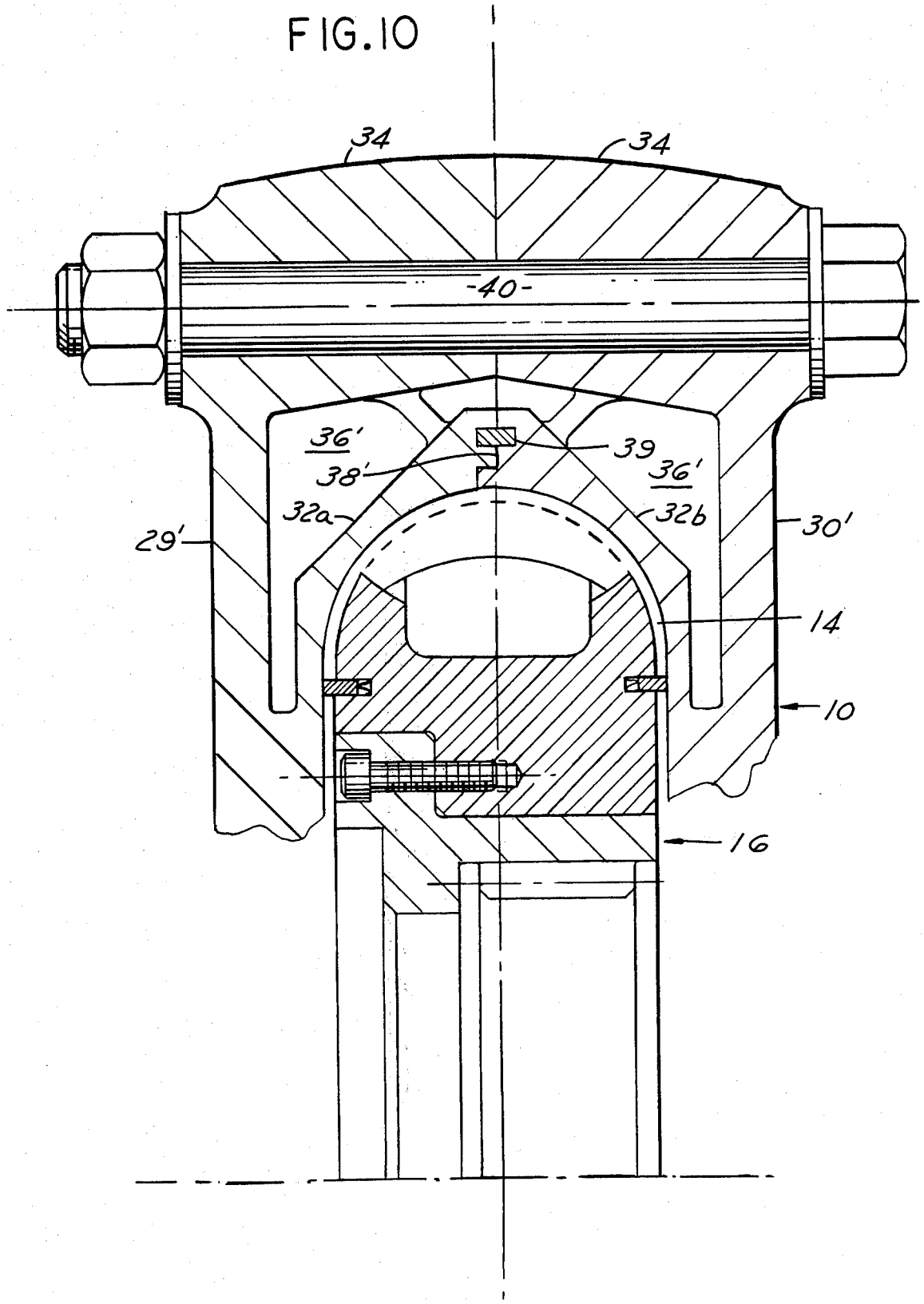
FIG. 10 is a sectional elevation similar to FIG. 2 but showing an alternative housing construction.

An alternative construction of the engine housing 10 is shown in FIG. 10. A housing member 29' is formed with a portion **32*a* of the chamber end member; a housing member 30' is formed with a complimentary portion 32*b* of the chamber end member; and each of the housing members 29' and 30' includes a portion of the coolant jacket 36'. An interlock 38' and gasket 39 are provided between the housing portions 32*a* and 32*b* and the interlock is engageable in response to abutment between the housing members, produced by tightening the bolts 40. Assembly of the rotor 16 and the seals 48 and 50** is facilitated with this construction.

The alternative end seal shown in FIG. 7A is similar to the construction previously described except that the outer peripheries 56' of the successive layers 51–55 are tapered inwardly toward the center layer 53, providing a plurality of sealing surfaces individually engageable with the end surface 28 of the chamber 14.

I claim:

1. In an internal combustion engine of the type having a housing, a shaft carried thereby, a chamber in the housing including a pair of parallel side surfaces spaced axially and extending radially of the rotational axis of the rotor and an end surface of generally semi-circular sectional configuration connecting said side surfaces, a rotor eccentrically mounted on the shaft for rotation in the chamber, the rotor having a pair of parallel side portions adjacent to the side surfaces of the chamber and a plurality of lobes each with an end portion of generally semi-circular sectional configuration adjacent to the end surface of the chamber, and end and side seal means respectively carried by the lobes and side portions of the rotor for engagement with the end and side surfaces of the chamber; the improvement wherein:

the end seal means on each lobe of the rotor comprises a plurality of pairs of axially opposed, self-expanding seal members arranged in adjacent layers, each layer extending circumferentially of the end portion of the lobe and being composed of a pair of the seal members having their adjacent ends circumferentially separated, the separations of adjacent layers being spaced circumferentially from each other, one of the seal members of each layer being joined to a first seal base and the other of the seal members of each layer being joined to a second seal base, a recess in each of the parallel side portions of the rotor adjacent to each of said end portions thereof receives one of the seal bases, each seal base being provided with a radially inwardly facing shoulder engageable by a portion of said side seal means, and means for resiliently urging each of said seal members into engagement with the chamber.

2. An internal combustion engine according to claim 1 further including intake and exhaust passages communicating with the chamber through grills having axially parallel openings in the end surface of the chamber, said openings being separated by end surface portions at least as wide as the circumferential separation between pairs of end seal members whereby said surface portions support the end seal means.

3. An internal combustion engine according to claim 1 wherein each seal base includes a radially outwardly facing shoulder engageable with a radially inwardly directed surface formed on each recess.

4. An internal combustion engine according to claim 3 wherein said side seal means includes a plurality of side seal members arranged in end-to-end relation, each side seal member extending from a radial line through the center of one lobe of the rotor to a corresponding radial line through the next adjacent lobe of the rotor, and said radially inwardly facing shoulder on each seal base is engageable by the end portions of adjacent side seal members.

5. An internal combustion engine according to claim 4 wherein the ends of adjacent side seal members are spaced apart to provide part of a lubricant passage to the end seal means along each of said radial lines.

6. An internal combustion engine according to claim 5 further comprising means for supplying a lubricant from the shaft to said end and side seal means.

7. An internal combustion engine according to claim 4 further including spring means for urging said side seal members axially into engagement with said side surfaces of the chamber.

8. An internal combustion engine according to claim 7 wherein each of said side seal members is provided with locating means engageable with the rotor for positioning each side seal member circumferentially of the rotor.

9. In an internal combustion engine of the type having a housing, a shaft carried thereby, a chamber in the housing including a pair of parallel side surfaces spaced axially and extending radially of the rotational axis of the rotor and an end surface of generally semi-circular sectional configuration connecting said side surfaces, a rotor eccentrically mounted on the shaft for rotation in the chamber, the rotor having a pair of parallel side portions adjacent to the side surfaces of the chamber and a plurality of lobes each with an end portion of generally semi-circular sectional configuration adjacent to the end surface of the chamber, and end and side seal means respectively carried by the lobes and side portions of the rotor for engagement with the end and side surfaces of the chamber; the improvement comprising:

passage means for supplying a lubricant from the shaft to the rotor and from the rotor to said side and end seal means, said passage means including grooves formed in the side portions of the rotor on radial lines extending through the centers of the lobes, each groove communicating with a passage through the side seal means to the end seal means.

10. An internal combustion engine according to claim 9 wherein said side seal means includes a plurality of side seal members arranged in end to end relation, each side seal member extending from the radial line through the center of one lobe to the radial line through the center of the next adjacent lobe, and the ends of adjacent side seal members are spaced apart to provide said passage through the side seal means to the end seal means.

11. An internal combustion engine according to claim 10 wherein the end seal means on each lobe of the rotor comprises a plurality of pairs of axially opposed, self-expanding seal members arranged in adjacent layers, each layer extending circumferentially of the end portion of the lobe and being composed of a pair of the seal members having their adjacent ends circumferentially separated, the separations of adjacent layers being spaced circumferentially from each other, and means for resiliently urging each of said seal members into engagement with the chamber end surface.

12. An internal combustion engine according to claim 1 or 9 wherein the housing comprises a pair of members having side portions including said side surfaces of the chamber and having outer portions disposed radially outward of the chamber and extending axially into abutment with each other, a chamber end member extending between said side portions and spaced radially inward of said outer portions to provide a coolant jacket around the chamber, said end member including said chamber end surface, sealing means between said housing side portions and chamber end member, and means for detachably interconnecting said housing members and chamber end member including fasteners extending axially through said housing member outer portions, and interlock means between said housing member side portions and the chamber end member engageable in response to axial abutment between said housing member outer portions.

* * * * *